US006260370B1

(12) United States Patent
Bottum, Sr. et al.

(10) Patent No.: US 6,260,370 B1
(45) Date of Patent: Jul. 17, 2001

(54) SOLAR REFRIGERATION AND HEATING SYSTEM USABLE WITH ALTERNATIVE HEAT SOURCES

(75) Inventors: Edward W. Bottum, Sr.; Edward W. Bottum, Jr., both of Brighton, MI (US)

(73) Assignee: Refrigeration Research, Inc., Brighton, MI (US)

( * ) Notice: Subject to any disclaimer, the term of this patent is extended or adjusted under 35 U.S.C. 154(b) by 0 days.

(21) Appl. No.: 09/384,604

(22) Filed: Aug. 27, 1999

(51) Int. Cl.[7] ..... F25B 27/00
(52) U.S. Cl. ..... 62/238.4; 62/500
(58) Field of Search ..... 62/235.1, 238.4, 62/500, 219, 506

(56) References Cited

U.S. PATENT DOCUMENTS

| | | | | |
|---|---|---|---|---|
| 2,199,779 | * | 5/1940 | Buchet | 62/219 |
| 2,475,897 | * | 7/1949 | Iwanski | 62/219 |
| 3,146,603 | * | 9/1964 | Porter, Jr. | 62/219 |
| 4,120,289 | | 10/1978 | Bottum . | |
| 4,142,678 | | 3/1979 | Bottum | 62/347 |
| 4,301,662 | * | 11/1981 | Whitnah | 62/238.4 |
| 4,321,801 | * | 3/1982 | Collard, Jr. | 62/238.4 |
| 4,345,440 | * | 8/1982 | Allen et al. | 62/238.4 |
| 4,383,419 | | 5/1983 | Bottum | 62/238.6 |
| 4,765,148 | * | 8/1988 | Ohashi | 62/500 |
| 5,419,155 | * | 5/1995 | Boehde et al. | 62/506 |

* cited by examiner

*Primary Examiner*—William E. Tapolcai
(74) *Attorney, Agent, or Firm*—MacMillan, Sobanski & Todd, LLC

(57) ABSTRACT

An apparatus for heating and cooling includes a solar collector for transferring heat energy from incident solar rays to a liquid refrigerant material thereby changing a first portion to a gaseous state. An eductor-venturi reduces a pressure of the gaseous refrigerant material and a condenser removes the heat energy thereby changing the refrigerant material back to the liquid state. A heat exchanger associated with the condenser receives the heat energy removed from the refrigerant material. A float evaporator mounted in a cold chamber transfers heat energy from the atmosphere to the liquid refrigerant material thereby changing a second portion to the gaseous state and cooling the cold chamber atmosphere. A float actuated valve connected to the float evaporator is responsive to a level of the liquid refrigerant material in the evaporator for regulating a flow of the liquid refrigerant material into the evaporator.

4 Claims, 1 Drawing Sheet

SOLAR REFRIGERATION AND HEATING SYSTEM USABLE WITH ALTERNATIVE HEAT SOURCES

BACKGROUND OF THE INVENTION

The present invention relates generally to a system for cooling and heating and, in particular, to an apparatus and method for both heating and cooling powered by a solar heat source.

The U.S. Pat. No. 4,120,289, issued on Oct. 17, 1978 to Edward W. Bottum, shows a solar water heating system including a solar collector connected to a heat exchanger in a closed loop charged with refrigerant. The refrigerant is boiled in the collector and condensed in the heat exchanger to give off heat to water passing through the heat exchanger.

It is known that a heat pump system can be utilized to make ice. The U.S. Pat. No. 4,142,678, issued on Mar. 6, 1979 to Edward W. Bottum, shows a heat pump system having a compressor, evaporator and condenser connected together for the circulation of fluid refrigerant. The evaporator is a plate element that collects heat from the sun's rays. During cooler periods or when there is no sunlight, water is sprayed on the underside of the evaporator plate. This water freezes and forms a layer of ice that can be removed and used. The formation of ice also generates heat that is available to the heat pump thereby increasing the efficiency of the system.

U.S. Pat. No. 4,383,419, issued on May 17, 1983 to Edward W. Bottum, shows a heating system employing a heat pump that is provided with heat by a second system employing refrigerant as a heat transfer medium. The refrigerant is boiled using heat energy from the ground or a body of water, for example.

SUMMARY OF THE INVENTION

The present invention concerns an apparatus for heating and cooling including a heat source for transferring incident heat energy to a liquid refrigerant material thereby changing the refrigerant material from the liquid state to a gaseous state. The heat source has an inlet for receiving the refrigerant material in the liquid state and an outlet for discharging the refrigerant material in the gaseous state.

A venturi reduces the pressure of the refrigerant material. A "venturi", as used herein, refers to a component having an inlet receiving higher-pressure gas and discharging it at a somewhat lower pressure through an outlet. It also has a second inlet capable of receiving gas at a considerably lower pressure (or vacuum) from an evaporator and discharging it through the same outlet Such a device is sometimes called an "eductor".

The venturi has a first inlet connected to the heat source outlet for receiving the gaseous refrigerant material and an outlet for discharging the reduced pressure gaseous refrigerant material. A condenser means removes heat energy from the refrigerant material, thereby changing the refrigerant material from the gaseous state to the liquid state. The condenser means has an inlet connected to the venturi outlet for receiving the reduced pressure gaseous refrigerant material and an outlet for discharging the refrigerant material in the liquid state. The condenser means outlet is connected to the heat source inlet to return the liquid refrigerant material to the heat source. A heat exchange means is associated with the condenser means for receiving the heat energy removed from the refrigerant material by the condenser means.

A cold chamber containing an atmosphere has an evaporator means mounted in it to transfer heat energy from the cold chamber atmosphere to the liquid refrigerant material thereby changing the refrigerant material from the liquid state to the gaseous state and cooling the cold chamber atmosphere. The evaporator means has an inlet connected to the condenser means outlet for receiving the liquid refrigerant material and an outlet connected to a second inlet of the venturi for discharging the gaseous refrigerant material to the venturi. A valve is connected to the evaporator means inlet and is responsive to a level of the liquid refrigerant material in the evaporator means to regulate a flow of the liquid refrigerant material into the evaporator means. As liquid refrigerant boils due to its reduced pressure, heat is absorbed.

The expansion means for the evaporator can be an expansion valve, a "low side float", or a capillary and a sight glass can be connected between the heat source and the venturi.

The invention also includes a method for simultaneously heating and cooling from a source of heat energy comprising the steps of: providing a source of liquid refrigerant material and transferring incident heat energy from a source of the heat energy to the liquid refrigerant material thereby changing a first portion of the refrigerant material from the liquid state to a gaseous state; reducing a pressure of the gaseous refrigerant material; removing the heat energy from the refrigerant material thereby condensing the reduced pressure gaseous refrigerant material to change the refrigerant material from the gaseous state to the liquid state; providing a heat exchange means for receiving the heat energy removed from the reduced pressure gaseous refrigerant material; evaporating a second portion of the liquid refrigerant material condensed from the reduced pressure gaseous refrigerant material by transferring heat energy from an atmosphere to the second portion of the liquid refrigerant material thereby changing the refrigerant material from the liquid state to the gaseous state and cooling the atmosphere; and returning the first portion of the liquid refrigerant material to the source of the liquid refrigerant material whereby the incident heat energy simultaneously produces heat energy in the heat exchange means and cools the atmosphere.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
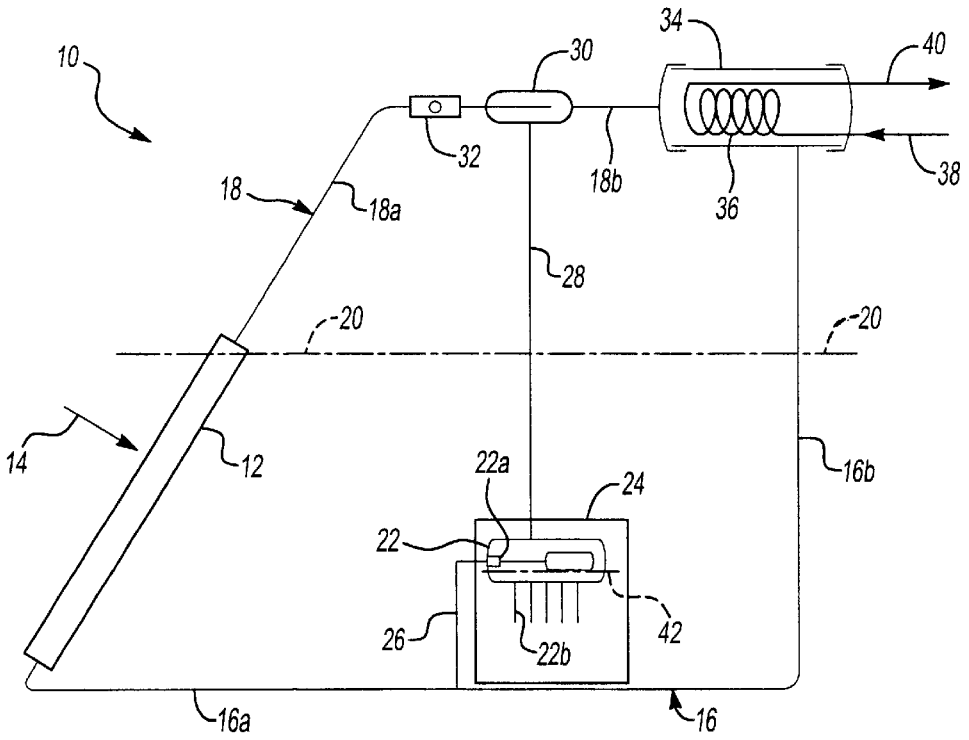
FIG. 1 is a schematic view of a solar powered cooling and heating apparatus in accordance with the present invention.

The present invention concerns a heating and cooling method and apparatus powered by a heating source. There is shown in the FIG. 1 a solar energy source powered system 10 for cooling and heating in accordance with a preferred embodiment of the present invention. The solar energy source includes a conventional solar collector 12 positioned at an angle such that it is exposed to the incident rays 14 of the sun (not shown). An inlet at a lower end of the solar connector 12 is connected to one end of a liquid line 16 and an outlet at an upper end of the solar collector is connected to one end of a vapor line 18. The liquid line 16 includes a generally horizontally extending first portion 16*a* connected between the solar collector 12 and a generally vertically extending second portion 16*b*.

The vapor line 18 includes a generally vertically extending first portion 18*a* connected between the solar collector 12 and a generally horizontally extending second portion 18*b*. As described below, the solar collector 12, the liquid line 16 and the vapor line 18 form a closed circulation path for the refrigerant material wherein the refrigerant material is in a liquid state below a generally horizontally extending liquid level 20. The liquid level 20 is shown as a broken line which intersects the solar collector 12 adjacent the upper end thereof and also intersects the second portion 16*b* of the liquid line 16 below an upper end thereof. The refrigerant material above the liquid level 20 is in a vapor or gaseous state.

A "low side" float evaporator 22 is mounted in a cold chamber 24. A first connecting tube 26 extends from the first portion 16*a* of the liquid line 16 to an inlet port of the float evaporator 22. A second connecting tube 28 extends from an outlet of the float evaporator 22 to a suction inlet of an expansion means such as a jet or venturi 30. The venturi 30 is inserted into the vapor line second portion 18*b* with a first inlet for receiving refrigerant from the solar collector 12 and an outlet. An optional sight glass 32 can be connected in the vapor line second portion 18*b* between the solar collector 12 and the inlet of the venturi 30. The ends of the lines 16 and 18 opposite the ends connected to the solar collector 12 are connected to a condenser 34. The vapor line second portion 18*b* is connected to an inlet of the condenser 34 and the liquid line second portion 16*b* is connected to an outlet of the condenser. A heat exchange means 36, such as a coil, is mounted inside the condenser and is connected between a cold water inlet line 38 and a hot water outlet line 40.

In operation, the solar collector 12 is exposed to the rays 14 of the sun which causes a first portion of the liquid refrigerant below the liquid level 20 to boil into a vapor. The vaporized refrigerant rises through the vapor line first portion 18*a* and flows through the sight glass 32 and the venturi 30 to the interior of the condenser 34. As the gaseous refrigerant flows through the venturi 30, a low pressure or vacuum is produced in the second connecting tube 28. The connecting tube 28 communicates the low pressure or vacuum to the interior of the float evaporator 22. A quantity of the liquid refrigerant is present in the evaporator 22 below a liquid level 42. The liquid refrigerant in the evaporator 22 will boil at the lower pressure communicated through the second connecting tube 28 and absorb heat from the surrounding atmosphere in the cold chamber 24. The absorption process can be aided by providing fins 22*b* on the exterior of the float evaporator 22 to expose more surface area to the atmosphere in the cold chamber 24. A vaporized second portion of the refrigerant material exits the evaporator 22 through the tube 28 and joins the vaporized first portion of the refrigerant material from the solar collector 12 in the venturi 30. As the liquid level in the evaporator 22 falls due to evaporation, a float valve 22*a* at the inlet opens to allow liquid refrigerant from the first connecting tube 26 to flow in and replace the evaporated liquid. When sufficient liquid refrigerant has entered the evaporator 22, the float valve 22*a* closes.

The heated gaseous refrigerant from the solar collector 12 and from the evaporator 22 enters the condenser 34. Cold water flowing into the coil 36 from the line 38 absorbs heat from the vaporized refrigerant and this hot water exits the condenser 34 through the hot water line 40. The refrigerant in the condenser 34 is cooled by this heat loss to the liquid state and flows into the liquid line second portion 16*b* to return to the solar collector 12. The vapor pressure in the condenser 34 will be slightly lower than the vapor pressure in upper end of the solar collector 12, but the liquid head in the liquid line second portion 16*b* is adequate to return the liquid refrigerant to the solar collector and to the inlet of the float evaporator 22.

Figure 2:
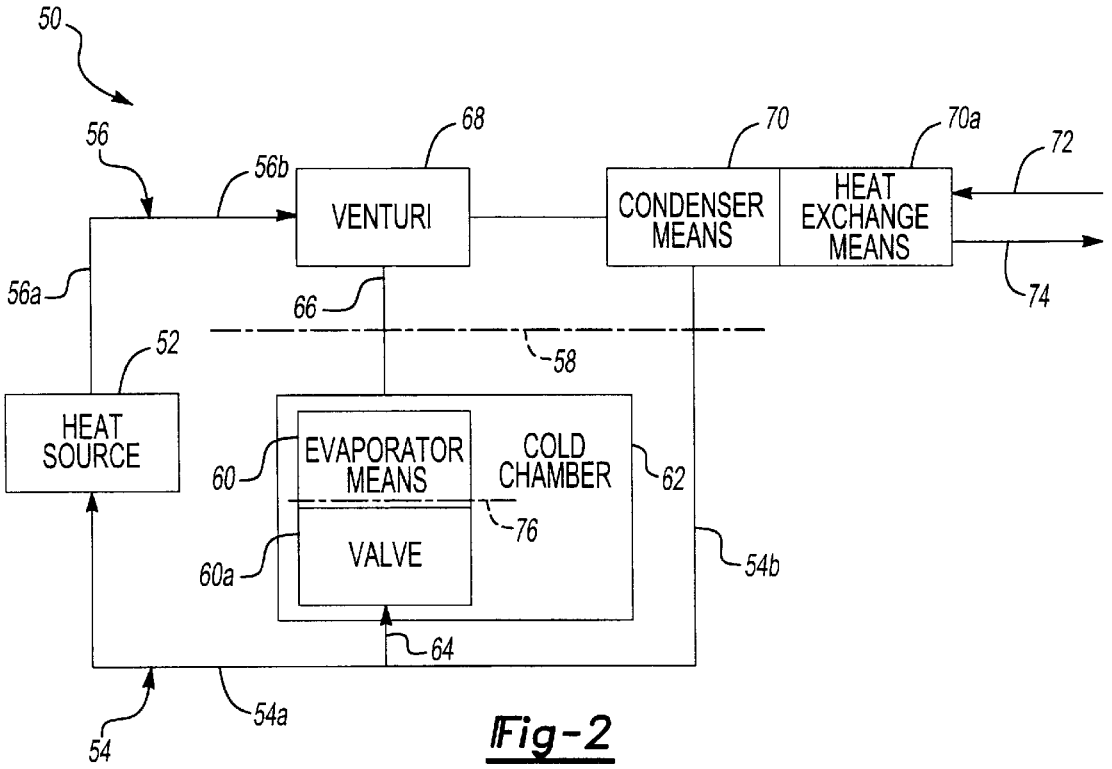
FIG. 2 is a schematic block diagram of a heating and cooling system in accordance with the present invention.

There is shown in the FIG. 2 a block diagram representation of the present invention wherein a heat source powered system 50 for cooling and heating includes a heat source 52 which can be the conventional solar collector 12 shown in the FIG. 1 or any other source of heat including electric, fossil fuel, fuel cell, the ground, a body of water, etc. An inlet at a lower end of the heat source 52 is connected to one end of a liquid line 54 and an outlet at an upper end of the heat source is connected to one end of a vapor line 56. The liquid line 54 includes a generally horizontally extending first portion 54*a* connected between the heat source 52 and a generally vertically extending second portion 54*b*. The vapor line 56 includes a generally vertically extending first portion 56*a* connected between the heat source 52 and a generally horizontally extending second portion 56*b*.

As described below, the heat source 52, the liquid line 54 and the vapor line 56 form a closed circulation path for the refrigerant material wherein the refrigerant material is in a liquid state below a generally horizontally extending liquid level 58. The liquid level 58 is shown as a broken line which intersects the heat source 52 and the second portion 54*b* of the liquid line 54 below an upper end thereof. The refrigerant material above the liquid level 58 is in a vapor or gaseous state.

A float evaporator 60 is mounted in a cold chamber 62. A first connecting tube 64 extends from the liquid line first portion 54*a* to an inlet port of the float evaporator 60. A second connecting tube 66 extends from an outlet of the float evaporator 60 to a 10 suction inlet of a venturi 68 such as the venturi 30 shown in the FIG. 1. The expansion means 60 also can be an expansion valve or a capillary inserted into the tube 64 with an inlet for receiving refrigerant from a condenser 70 and an outlet. The ends of the lines 54 and 56 opposite the ends connected to the heat source 52 are connected to the condenser 70. The vapor line second portion 56*b* is connected to an inlet of the condenser 70 and the liquid line second portion 54*b* is connected to an outlet of the condenser. A heat exchange means 70*a*, such as the coil 36 shown in the FIG. 1, is mounted inside the condenser 70 and is connected between an inlet line 72 and an outlet line 74.

The operation of the system 50 is similar to the operation of the system 10 shown in the FIG. 1. The heat source 52 heats the liquid refrigerant below the liquid level 58 to create a vapor. The vaporized refrigerant rises through the vapor line first portion 56*a* and flows through the venturi 68 to the interior of the condenser 70. As the gaseous refrigerant flows through the venturi 68, a low pressure or vacuum is produced in the second connecting tube 66 which low pressure or vacuum is communicated to the interior of the float evaporator 60. A quantity of the liquid refrigerant is present in the evaporator 60 below a liquid level 76. The liquid refrigerant in the evaporator 60 will boil at the lower pressure communicated through the second connecting tube 66 and absorb heat from the surrounding atmosphere in the cold chamber 62. The vaporized refrigerant exits the evaporator 60 through the tube 66 and joins the vaporized refrigerant from the heat source 52 in the venturi 68. As the liquid level in the evaporator 60 falls due to evaporation, a valve means 60*a*, such as the float valve 22*a* shown in the FIG. 1, opens to allow liquid refrigerant from the first connecting tube 64 to flow in and replace the evaporated liquid. When sufficient liquid refrigerant has entered the evaporator 60, the float valve 60*a* closes.

The heated gaseous refrigerant from the heat source 52 and from the evaporator 60 enters the condenser 70. A cold transfer medium, liquid or gas, flowing into the condenser 70 from the inlet line 72 absorbs heat from the vaporized refrigerant and this hot transfer medium exits the condenser through the outlet line 74. The gaseous refrigerant in the condenser 70 is cooled by this heat loss to the liquid state and flows into the liquid line second portion 54*b* to return to the heat source 52. The vapor pressure in the condenser 70 will be slightly lower than the vapor pressure in upper end of the heat source 52, but the liquid head in the liquid line second portion 54*b* is adequate to return the liquid refrigerant to the heat source and to the inlet of the float evaporator 60.

The apparatus (10, 50) for heating and cooling according to the present invention includes the heat source (12, 52) for transferring incident heat energy to a liquid refrigerant material thereby changing the refrigerant material from the liquid state to a gaseous state, the heat source having an inlet for receiving the refrigerant material in the liquid state and an outlet for discharging the refrigerant material in the gaseous state; the venturi (30, 68) for reducing a pressure of the refrigerant material, the venturi having an inlet connected to the heat source outlet for receiving the gaseous refrigerant material and having an outlet for discharging the reduced pressure gaseous refrigerant material; the condenser means (34, 70) for removing heat energy from the refrigerant material thereby changing the refrigerant material from the gaseous state to the liquid state, the condenser means having an inlet connected to the venturi outlet for receiving the reduced pressure gaseous refrigerant material and an outlet for discharging the refrigerant material in the liquid state, the condenser means outlet being connected to the heat source inlet for returning the liquid refrigerant material to the heat source; the heat exchange means (36, 70*a*) associated with the condenser means for receiving the heat energy removed from the refrigerant material by the condenser means; the cold chamber (24, 62) containing an atmosphere; the evaporator means (22, 60) mounted in the cold chamber for transferring heat energy from the cold chamber atmosphere to the liquid refrigerant material thereby changing the refrigerant material from the liquid state to the gaseous state and cooling the cold chamber atmosphere, the evaporator means having an inlet connected to the condenser means outlet for receiving the liquid refrigerant material and having an outlet connected to another inlet of the expansion means for discharging the gaseous refrigerant material to the expansion means; and the valve (22*a*, 60*a*) connected to the evaporator means inlet and being responsive to a level of the liquid refrigerant material in the evaporator means for regulating a flow of the liquid refrigerant material into the evaporator means whereby the heat energy incident upon the heat source produces heat energy in the heat exchange means and cools the cold chamber atmosphere.

The method according to the present invention for simultaneously heating and cooling from a source of heat energy comprises the steps of: a. providing a source of liquid refrigerant material and transferring incident heat energy from a source of the heat energy to the liquid refrigerant material thereby changing a first portion of the refrigerant material from the liquid state to a gaseous state; b. reducing a pressure of the gaseous refrigerant material; c. removing the heat energy from the refrigerant material thereby condensing the reduced pressure gaseous refrigerant material to change the refrigerant material from the gaseous state to the liquid state; d. providing a heat exchange means for receiving the heat energy removed from the reduced pressure gaseous refrigerant material; e. evaporating a second portion of the liquid refrigerant material condensed from the reduced pressure gaseous refrigerant material by transferring heat energy from an atmosphere to the second portion of the liquid refrigerant material thereby changing the refrigerant material from the liquid state to the gaseous state and cooling the atmosphere; and f. returning the first portion of the liquid refrigerant material to the source of the liquid refrigerant material whereby the incident heat energy simultaneously produces heat energy in the heat exchange means and cools the atmosphere. The method also includes adding the gaseous first portion of the refrigerant material to the gaseous second portion of the refrigerant material prior to performing the step c.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus using incident heat energy and a refrigerant material for heating a transfer medium and cooling an atmosphere comprising:

a heat source for transferring incident heat energy to a liquid refrigerant material thereby changing the refrigerant material from the liquid state to a gaseous state, said heat source having an inlet for receiving the refrigerant material in the liquid state and an outlet for discharging the refrigerant material in the gaseous state;

a venturi for reducing a pressure of the refrigerant material, said venturi having a first inlet connected to said heat source outlet for receiving the gaseous refrigerant material, an outlet for discharging the reduced pressure gaseous refrigerant material and a second inlet;

a condenser means for removing heat energy from the refrigerant material thereby changing the refrigerant material from the gaseous state to the liquid state, said condenser means having an inlet connected to said venturi outlet for receiving the reduced pressure gaseous refrigerant material and an outlet for discharging the refrigerant material in the liquid state, said condenser means outlet being connected to said heat source inlet for returning the liquid refrigerant material to said heat source;

a heat exchange means associated with said condenser means for receiving the heat energy removed from the refrigerant material by said condenser means, said heat exchange means having an inlet line and an outlet line for circulating a transfer medium to absorb the heat energy removed from the refrigerant material for heating purposes;

a cold chamber containing an atmosphere; and an evaporator means mounted in said cold chamber for transferring heat energy from the cold chamber atmosphere to the liquid refrigerant material thereby changing the refrigerant material from the liquid state to the gaseous state and cooling the cold chamber atmosphere for cooling purposes, said evaporator means having an inlet connected to said condenser means outlet for receiving the liquid refrigerant material and having an outlet connected to said second inlet of said venturi for discharging the gaseous refrigerant material to said venturi whereby a first portion of the refrigerant material circulates through said heat source for heating said transfer medium from the incident heat energy and simultaneously a second portion of the refrigerant material circulates through said evaporator means for heating said transfer medium and cooling the atmosphere in said cold chamber.

2. The apparatus according to claim 1 wherein said evaporator means is one of a low side float and an expansion valve.

3. The apparatus according to claim 1 including a sight glass connected between said heat source and said venturi.

4. The apparatus according to claim 1 including a valve connected to said evaporator means inlet and being responsive to a level of the liquid refrigerant material in said evaporator means for regulating a flow of the liquid refrigerant material into said evaporator means whereby the heat energy incident upon said heat source produces heat energy in said heat exchange means and cools the cold chamber atmosphere.

* * * * *